US010374318B2

(12) United States Patent
Moldovan

(10) Patent No.: US 10,374,318 B2
(45) Date of Patent: Aug. 6, 2019

(54) MINIATURE ANTENNA

(71) Applicant: Dialog Semiconductor B.V., s-Hertogenbosch (NL)

(72) Inventor: Eugen Moldovan, Eindhoven (NL)

(73) Assignee: Dialog Semicondcutor B.V., s-Hertogenbosch (NL)

( * ) Notice: Subject to any disclaimer, the term of this patent is extended or adjusted under 35 U.S.C. 154(b) by 167 days.

(21) Appl. No.: 15/348,065

(22) Filed: Nov. 10, 2016

(65) Prior Publication Data

US 2017/0133765 A1 May 11, 2017

(30) Foreign Application Priority Data

Nov. 10, 2015 (DE) ..... 10 2015 222 131

(51) Int. Cl.

| | |
|---|---|
| ***H01Q 1/22*** | (2006.01) |
| ***H01Q 1/38*** | (2006.01) |
| ***H01Q 1/48*** | (2006.01) |
| ***H01Q 9/04*** | (2006.01) |
| ***H01Q 13/16*** | (2006.01) |

(52) U.S. Cl.

CPC ..... *H01Q 13/16* (2013.01); *H01Q 1/2283* (2013.01); *H01Q 1/38* (2013.01); *H01Q 1/48* (2013.01); *H01Q 9/0485* (2013.01)

(58) Field of Classification Search

CPC .... H01Q 13/16; H01Q 1/2283; H01Q 9/0485; H01Q 1/38; H01Q 1/48

See application file for complete search history.

(56) References Cited

U.S. PATENT DOCUMENTS

| | | | | |
|---|---|---|---|---|
| 6,097,347 A * | 8/2000 | Duan | H01Q 1/2225 | 343/802 |
| 2004/0135726 A1* | 7/2004 | Shamir | H01Q 1/36 | 343/700 MS |
| 2012/0212389 A1* | 8/2012 | Aizawa | H01Q 1/36 | 343/853 |

(Continued)

OTHER PUBLICATIONS

German Office Action, File No. 10 2015 222 131.8, Applicant: Dialog Semiconductor B.V., dated Jul. 18, 2016, 7 pgs and English language translation, 7 pgs.

*Primary Examiner* — Dameon E Levi
*Assistant Examiner* — Jennifer F Hu
(74) *Attorney, Agent, or Firm* — Saile Ackerman LLC; Stephen B. Ackerman

(57) ABSTRACT

A split open loop resonator antenna comprising a first electrically connected open loop structure which comprises a first slit, a second electrically connected open loop structure containing a second slit. The first electrically connected open loop structure contains a first main structure being a portion of a first open loop and a first additional structure being another portion of the first open loop. The second electrically connected open loop structure has a second main structure. The first main structure is arranged in a first plane. The first additional structure is arranged in a second plane different from the first plane. The plurality of planes are parallel to each other and the first main structure is electrically connected to the first additional structure. The first main structure and the first additional structure are arranged such that when projected in a same plane they cover first open loop shape.

25 Claims, 8 Drawing Sheets

(56) References Cited

U.S. PATENT DOCUMENTS

| | | | | |
|---|---|---|---|---|
| 2013/0082897 | A1* | 4/2013 | Liu | H01Q 1/36 343/893 |
| 2015/0162666 | A1* | 6/2015 | Puente Baliarda | H01Q 1/36 343/843 |

* cited by examiner

MINIATURE ANTENNA

TECHNICAL FIELD

The invention relates to miniature antennas, and in particular, to electrically small printed on Printed Circuit Board (PCB) antennas.

BACKGROUND

Antennas are used in telecommunication applications for radiating or receiving electromagnetic waves, or both. There are multiple kinds of antennas, such as monopole antennas, dipole antennas, inverted F antennas, or split ring resonators (which is also called zeroth order resonator (ZOR)), etc.

FIG. 1 shows a known split ring resonator antenna. The split ring resonator antenna of FIG. 1 comprises an inner ring 7 and an outer ring 3 wherein the inner ring 7 comprises a slit 9 and the outer ring 3 comprises a slit 5. The split ring resonator antenna of FIG. 1 also comprises a slot 15 that can be used for impedance matching and connection to a feeding line 17.

The size of any antenna is proportional to the wavelength λ of the frequency at which the antenna is intended to operate (receive/transmit). There is an optimum size of the antenna where it exhibits its best performance. Decreasing the size of the antenna comes at performance costs most notably the radiation efficiency of the antenna and the usable frequency bandwidth.

Different techniques are known for reducing the size of an antenna while aiming at minimizing the loss in performance. For instance, a mirror image of the half of the antenna can be created by using a groundplane. Another technique is based on optimizing the antenna geometry for example by 3D folding the antenna. However, the techniques used to decrease antenna size are generally frequency sensitive, i.e. will reduce the bandwidth of the antenna and increase resistance losses due to the increased concentration of currents.

"A compact MIMO Antenna using ZOR Split Ring Resonator Radiators with a decoupling Structure" by Seongryong Yoo and Sungtek Kahng discloses a split ring resonator antenna.

SUMMARY

In a first aspect, the invention provides a split open loop resonator antenna comprising:

a first electrically connected open loop structure, said first electrically connected open loop structure comprising a first slit;

a second electrically connected open loop structure said second electrically connected open loop structure comprising a second slit;

said first electrically connected open loop structure comprising at least a first main structure being a portion of a first open loop with a first open loop shape and a first additional structure being another portion of said first open loop, said second electrically connected open loop structure comprising at least a second main structure, said first main structure being arranged in a first plane of a plurality of planes, said first additional structure being arranged in a second plane of said plurality of planes different from said first plane, said plurality of planes being parallel to each other and said first main structure being electrically connected to said first additional structure, said first main structure and said first additional structure being arranged such that when projected in a first same plane parallel to said first and second planes they cover at least said first open loop shape with said first slit.

By doing so, separate portions of at least one open loop of the antenna are arranged on at least two different planes. This allows to provide a more compact design of the antenna while still keeping a good antenna performance. The antenna can be smaller due to the split ring resonator structure and due to the 3D folding on at least two different planes. It also shows higher radiation efficiency compared to other miniaturized designs based on full size antennas. It also allows the antenna to have a broad frequency band while at the same time reducing the size of the antenna. Unfolding at least one of the open loops of the antenna in at least two different planes also provides an antenna which performance depends less on the groundplane size of the antenna.

The second main structure may be a portion of a second open loop with a second open loop shape with a second open loop shape and being arranged in a third plane of said plurality of planes that may coincide with the first plane, said second electrically connected open loop structure comprising at least a second additional structure being another portion of said second open loop, said second additional structure being arranged in a fourth plane of said plurality of planes that may coincide with said second plane and said second main structure being electrically connected to said second additional structure, said second main structure and said second additional structure being arranged such that when projected in a second same plane parallel to said third and fourth planes they cover at least said second open loop shape with said second slit.

By doing so, both rings of the antenna, outer and inner open loops, have different portions that are arranged on at least two different planes, thereby providing an even more compact design. Therefore, the same radiation and bandwidth performance can be achieved with a smaller antenna.

The split open loop resonator antenna may further comprise a dielectric substrate, such that said first and second main structures are arranged on said dielectric substrate and said first additional structure are arranged on said dielectric substrate.

The dielectric substrate may comprise a high dielectric material.

This provides a compact design of the antenna. The size of the antenna decreases inversely proportional to the square root of the dielectric constant of the substrate on which the antenna is arranged. Thus, using materials with higher dielectric constant we can further reduce the antenna size.

The first electrically connected open loop structure may further comprise at least a first prolongation structure extending from said first electrically connected open loop structure and being arranged to operate as a first stub.

The second electrically connected open loop structure may comprise at least a second prolongation structure extending from said second electrically connected open loop structure and being arranged to operate as a second stub.

In this way, the frequency tuning of the antenna is improved. The resonance frequency of the antenna can be changed by modifying the size of the stubs. The stubs are designed as a prolongations of the two split open loops. This allows for having a compact design of the antenna with the stubs.

The first electrically connected open loop structure may comprise a slot for impedance matching.

The second electrically connected open loop structure may comprise a slot for impedance matching.

By changing the length of the slot, it is possible to fine tune the antenna impedance. This provides an efficient way of matching the impedance. By adjusting the slot length, the bandwidth versus efficiency of the antenna may also be changed. The antenna may be made either more efficient but with a narrower bandwidth or less efficient but broadband by changing the length of the slot. In this way, it is possible to increase the bandwidth at the price of efficiency and vice-versa.

The first electrically connected open loop structure and/or the second electrically connected open loop structure may comprise an annular shape.

This is a convenient shape for the open loops of the antenna.

The first main structure may comprise a first main member, a second main member and a third main member, said first main member, said second main member and said third main member being electrically connected, said first main member and said third main member being parallel to each other, said second main member being perpendicular respectively to said first main member and said third main member, such that said first main member, said second main member and said third main member form a U-shaped structure, said first additional structure comprising at least one first additional member and at least one second additional member arranged such as to define said first slit, said first additional member and second additional member, respectively, being electrically connected to said first main member and said third main member, respectively, through a first auxiliary member and a second auxiliary member, respectively, both extending from the first plane to the second plane.

The second main structure may comprise at least one fourth main member and at least one fifth main member, said at least one fourth main member and said at least one fifth main member being parallel to each other, and said second additional structure comprising at least one third additional member and at least one fourth additional member, said at least one fourth additional member comprising submembers arranged such as to define said second slit, said at least one third additional member and said at least one fourth additional member being parallel to each other, said at least one third additional member and said fourth additional member being perpendicular to said at least one fourth main member and said at least one fifth main member, said at least one fourth main member being respectively electrically connected to said at least one third additional member and said at least one fourth additional member through respectively a third auxiliary structure and a fourth auxiliary structure, and said at least one fifth main member being respectively electrically connected to said at least one third additional member and said at least one fourth additional member through respectively a fifth auxiliary structure and a sixth auxiliary structure.

The antenna is based on the structure of the split ring resonator, also known as zeroth order resonator. The most important feature of this structure is that it can sustain resonances at frequencies much lower than the ones dictated by its size. This property may be used to further decrease the antenna size. The challenge is to find the right balance between a broad matching frequency band and high radiation performance (radiation efficiency). This is a figure of merit for electrically small antennas and is given by the bandwidth*efficiency product. The split open loops must be placed on at least two different PCB layers and at minimum distance such that they remain closely coupled. Vias or auxiliary structures can be used to alternatively route the open loops on the PCB layers.

The person skilled in the art will understand that the features described above may be combined in any way deemed useful.

BRIEF DESCRIPTION OF THE DRAWINGS

In the following, aspects of the invention will be elucidated by means of examples, with reference to the drawings. The drawings are diagrammatic and may not be drawn to scale.

The features and effects of the present invention will be explained in more detail below with reference to drawings in which preferred and illustrative embodiments of the invention are shown. The person skilled in the art will realize that other alternatives and equivalent embodiments of the invention can be conceived and reduced to practice without departing from the scope of the present invention. The scope is only limited by the annexed claims and their technical equivalents.

DESCRIPTION

The examples and embodiments described herein serve to illustrate rather than to limit the invention. The person skilled in the art will be able to design alternative embodiments without departing from the scope of the claims. Reference signs placed in parentheses in the claims shall not be interpreted to limit the scope of the claims. Items described as separate entities in the claims or the description may be implemented as a single or multiple hardware items combining the features of the items described.

It is to be understood that the invention is limited by the annexed claims and its technical equivalents only. In this document and in its claims, the verb "to comprise" and its conjugations are used in their non-limiting sense to mean that items following the word are included, without excluding items not specifically mentioned. In addition, reference to an element by the indefinite article "a" or "an" does not exclude the possibility that more than one of the element is present, unless the context clearly requires that there be one and only one of the elements. The indefinite article "a" or "an" thus usually means "at least one".

FIG. 2-5 show different views of the 3D folded split open loop resonator antenna.

In FIG. 2-5 the same reference numbers refer to the same features.

Figure 1:
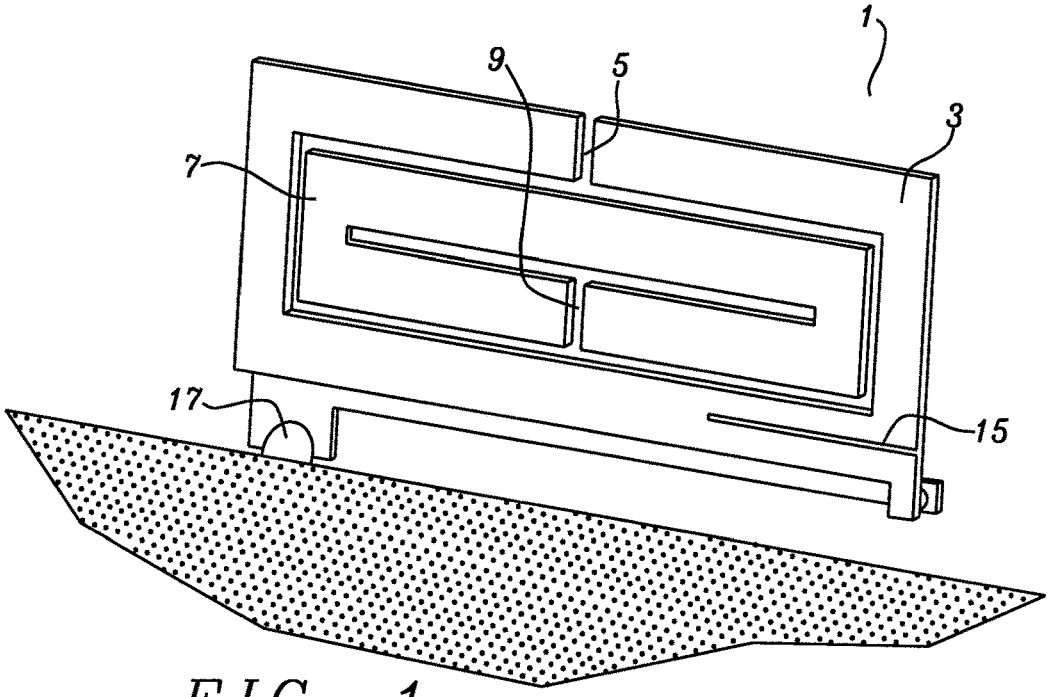
FIG. 1 shows a known split ring resonator antenna.
Figure 2:
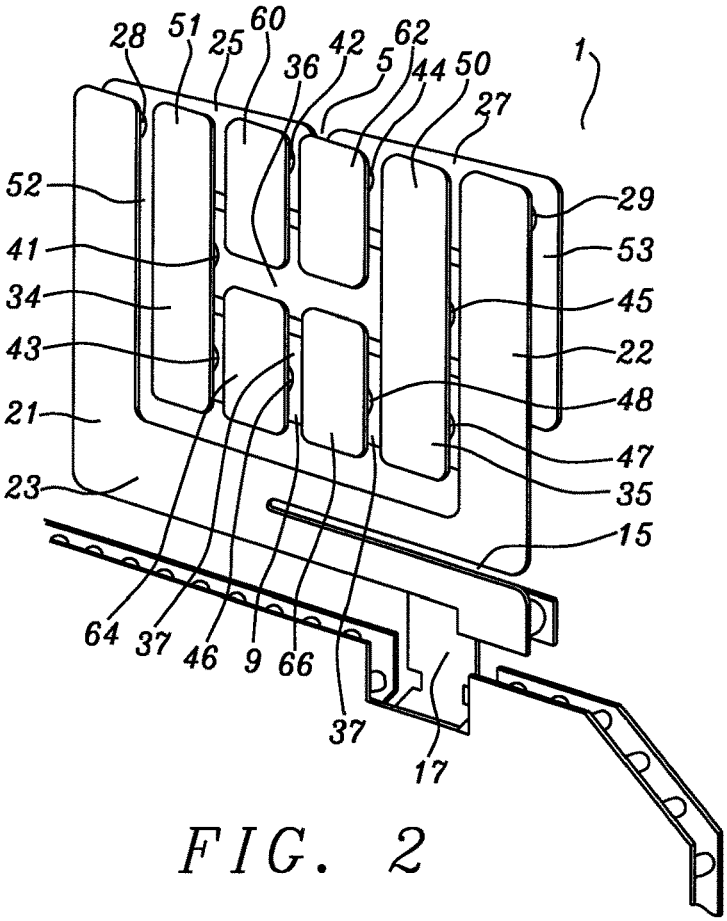
FIG. 2 shows a front view of a 3D folded split ring resonator antenna according to an embodiment of the invention.

FIG. 2 shows a front view of a 3D folded split open loop resonator antenna according to an embodiment of the invention. The split open loop resonator antenna of FIG. 2 comprises an inner open loop and an outer open loop which are respectively 3D folded. The inner open loop of the split open loop resonator antenna of FIG. 2 comprises separate parts that are electrically connected to one another. The outer open loop of the split open loop resonator antenna of FIG. 2 comprises separate parts too which are electrically connected to one another. The outer open loop of the split open loop resonator antenna of FIG. 2 comprises a slit 5. The inner open loop of the split open loop resonator antenna of FIG. 2 comprises a slit 9.

The split open loop resonator antenna of FIG. 2 is connected to a feeding line 17 for feeding the split open loop resonator antenna with appropriate electrical signals from a transmitter connected to the antenna or to feed signals as received by the antenna to a receiver to which the antenna is connected. The split open loop resonator antenna of FIG. 2 may be attached to a ground.

The parts of the inner open loop and the parts of the outer open loop of the split open loop resonator antenna of FIG. 2 may be arranged in at least two different planes. The at least two different planes may be parallel to each other. The parts of the inner open loop and the parts of the outer open loop of the split open loop resonator antenna of FIG. 2 may be arranged in any number of suitable different planes which are also parallel to each other (not shown). Another possibility may be that only the parts of the inner open loop or the parts of the outer open loop of the split open loop resonator antenna of FIG. 2 are arranged in at least two different planes. For instance, the inner open loop of the split open loop resonator antenna of FIG. 2 may be completely arranged in only one plane while parts of the outer open loop are arranged in two different planes or in any other number of suitable different planes. On the other hand, the outer open loop of the split open loop resonator antenna of FIG. 2 may be completely arranged in only one plane while parts of the inner open loop are arranged in two different planes or any other suitable number of different planes. The inner open loop may be completely arranged in only one plane while a parts of the outer open loop are arranged in two different planes other than the plane wherein the inner open loop is arranged. The outer open loop may be completely arranged in only one plane while a parts of the inner open loop are arranged in two different planes other than the first plane other than the plane wherein the outer open loop is arranged.

The first electrically connected open loop structure and/or the second electrically connected open loop structure may comprise an annular shape. The first electrically connected open loop structure and/or the second electrically connected open loop structure may comprise a ring shape. The first electrically connected open loop structure and/or the second electrically connected open loop structure may comprise an oval shape. The first electrically connected open loop structure and/or the second electrically connected open loop structure may comprise a square shape. The first electrically connected open loop structure and/or the second electrically connected open loop structure may comprise a rectangular shape. The first electrically connected open loop structure and/or the second electrically connected open loop structure may comprise an annular shape. The first electrically connected open loop structure and/or the second electrically connected open loop structure may comprise any other suitable open loop shape. The first electrically connected open loop structure and/or the second electrically connected open loop structure may comprise any suitable combination of shapes. For instance, the first electrically connected open loop and/or the second electrically connected open loop structure may comprise a semiannular shape such that only the outside of the first electrically connected open loop and/or the outside of the second electrically connected open loop structure may comprise an annular shape. The first electrically connected open loop and/or the second electrically connected open loop structure may comprise a semiannular shape such that only the inside of the first electrically connected open loop and/or the inside of the second electrically connected open loop structure may comprise an annular shape.

The first electrically connected open loop structure and the second electrically connected open loop structure may be arranged such that when both are projected in a plane parallel to the plurality of planes wherein the first electrically connected open loop structure and the second electrically connected open loop structure are arranged, the first electrically connected open loop structure surrounds the second electrically connected open loop structure or viceversa. I.e., the first electrically connected open loop structure and the second electrically connected open loop structure may be arranged such that, when projected in a plane parallel to the plurality of planes wherein the first electrically connected open loop structure and the second electrically connected open loop structure are arranged, the first electrically connected open loop structure is embedded in the second electrically connected open loop structure or viceversa. The first electrically connected open loop structure and the second electrically connected open loop structure may be concentric.

The outer open loop of the split open loop resonator antenna of FIG. 2 may comprise a main structure arranged in a first plane. The main structure of the outer open loop of the split open loop resonator antenna of FIG. 2 may comprise a first main member 21, a second main member 22 and a third main member 23 being electrically connected to each other. The main structure of the outer open loop of the split open loop resonator antenna of FIG. 2 may comprise any suitable number of members. The first main member 21 and the third main member 23 of the outer open loop of the split open loop resonator antenna of FIG. 2 may be parallel to each other. The second main member 22 of the outer open loop of the split open loop resonator antenna of FIG. 2 may be perpendicular to the first main member 21 and may be perpendicular to the third main member 23 thereby forming a U-shaped structure. The first main member 21, the second main member 22 and the third main member 23 of the outer open loop of the split open loop resonator antenna of FIG. 2 may be arranged with respect to each other in any other suitable way.

The outer open loop of the split open loop resonator antenna of FIG. 2 may comprise an additional structure in a second plane which is different from the first plane. The additional structure of the outer open loop of the split open loop resonator antenna of FIG. 2 may comprise a first additional member 25 and a second additional member 27. The additional structure of the outer open loop of the split open loop resonator antenna of FIG. 2 may comprise any suitable number of additional members. The first additional member 25 and the second additional member 27 of the outer open loop of the split open loop resonator antenna of FIG. 2 may be arranged such as to define the first slit 5. The first additional member 25 of the outer open loop of the split open loop resonator antenna of FIG. 2 may be electrically connected to the first main member 21 through a first auxiliary member 28 extending from the first plane to the second plane. The second additional member 27 of the outer open loop of the split open loop resonator antenna of FIG. 2 may be electrically connected to the third main member 23 through a second auxiliary member 29 extending from the first plane to the second plane. The outer open loop of the split open loop resonator antenna of FIG. 2 may comprise any suitable number of structures in a first plane and/or any suitable number of structures in a second plane different from the first plane. The outer open loop of the split open loop resonator antenna of FIG. 2 may comprise any suitable number of structures distributed in any suitable number of different planes. Each of those structures may comprise any suitable number of members. The members may be electrically connected in any suitable way through any suitable number of auxiliary structures extending from one plane to another.

The first main structure of the outer open loop of the split open loop resonator antenna may be a portion of a first open loop with a first open loop shape and the first additional structure of the outer open loop of the split open loop resonator antenna may be another portion of the same first open loop such that when projected in a first same plane parallel to said first and second planes they cover at least the first open loop shape. The first open loop shape of the first open loop may be an annular shape. The first open loop shape of the first open loop may be a ring shape. The first open loop shape of the first open loop may be a rectangular shape. The first open loop shape of the first open loop may be a square shape. The first open loop shape of the first open loop may be an oval shape. The first open loop shape of the first open loop may be any other suitable open loop shape. The first open loop shape of the first open loop may be any suitable combination of shapes. For instance, the first open loop shape of the first open loop may be a semiannular shape such that only the outside of the first open loop shape of the first open loop may be an annular shape while the inside of the first open loop shape of the first open loop may be a square shape. The first open loop shape of the first open loop may be a semiannular shape such that only the inside of the first open loop shape of the first open loop may be an annular shape while the outside of the first open loop shape of the first open loop may be a square shape.

The outer open loop may comprise slot 15. This slot 15 may be used for impedance matching of the antenna. By modifying the length of the slot 15, the radiation performance of the antenna may also be modified.

The inner open loop of the split open loop resonator antenna of FIG. 2 may comprise a fourth main member 34 and a fifth main member 35 arranged in the first plane. The inner open loop of the split open loop resonator antenna of FIG. 2 may comprise any suitable number of main members arranged in the first plane. The fourth main member 34 and the fifth main member 35 of the inner open loop of the split open loop resonator antenna of FIG. 2 may be parallel to each other. The inner open loop of the split open loop resonator antenna of FIG. 2 may comprise a second additional structure arranged in the second plane different from the first plane. The second additional structure of the inner open loop of the split open loop resonator antenna of FIG. 2 may comprise a third additional member 36 and a fourth additional member 37. The second additional structure of the inner open loop of the split open loop resonator antenna of FIG. 2 may comprise any other number of additional members arranged in a second plane different from the first plane. The fourth additional member 37 may comprise submembers defining the second slit 9. The third additional member 36 and the fourth additional member 37 may be parallel to each other. The third additional member 36 and the fourth additional member 37 may be perpendicular to the fourth main member 34 and to the fifth main member 35. The fourth main member 34 may be electrically connected to the third additional member 36 through a third auxiliary structure 41 extending from the first plane to the second plane. The fourth main member 34 may be electrically connected to the fourth additional member 37 through a fourth auxiliary structure 42 extending from the first plane to the second plane. The fifth main member 35 may be electrically connected to the third additional member 36 through a fifth auxiliary structure 43 extending from the first plane to the second plane. The fifth main member 35 may be electrically connected to the fourth additional member 37 through a sixth auxiliary structure 47 extending from the first plane to the second plane.

The main structure of the outer open loop of the split open loop resonator antenna of FIG. 2 may comprise a sixth main member 60 and a seventh main member 62 arranged in the first plane. The first additional member 25 of the outer open loop of the split open loop resonator antenna of FIG. 2 may be electrically connected to the sixth main member 60 through a seventh auxiliary member 42 extending from the first plane to the second plane. The second additional member 27 of the outer open loop of the split open loop resonator antenna of FIG. 2 may be electrically connected to the seventh main member 62 through an eighth auxiliary member 44 extending from the first plane to the second plane.

The inner open loop of the split open loop resonator antenna of FIG. 2 may comprise a eighth main member 64 and a ninth main member 66 arranged in the first plane The fourth additional member 37 of the inner open loop of the split open loop resonator antenna of FIG. 2 may be electrically connected to the eighth main member 64 through a tenth auxiliary member 46 extending from the first plane to the second plane. The fourth additional member 37 of the inner open loop of the split open loop resonator antenna of FIG. 2 may be electrically connected to the ninth main member 66 through a eleventh auxiliary member 48 extending from the first plane to the second plane.

The main structure of the inner open loop of the split open loop resonator antenna may be a portion of a second open loop with a second open loop shape and the additional structure of the inner open loop of the split open loop resonator antenna may be another portion of the same second open loop such that when projected in a second same plane parallel to said first and second planes they cover at least the second open loop shape. The second open loop shape of the second open loop may be an annular shape. The second open loop shape of the second open loop may be a ring shape. The second open loop shape of the second open loop may be a rectangular shape. The second open loop shape of the second open loop may be a square shape. The second open loop shape of the second open loop may be an oval shape. The second open loop shape of the second open loop may be any other suitable open loop shape. The second open loop shape of the second open loop may be any suitable combination of shapes. For instance, the second open loop shape of the second open loop may be a semiannular shape such that only the outside of the second open loop shape of the second open loop may be an annular shape while the inside of the second open loop shape of the second open loop may be a square shape. The second open loop shape of the second open loop may be a semiannular shape such that only the inside of the second open loop shape of the second open loop may be an annular shape while the outside of the second open loop shape of the second open loop may be a square shape.

The inner open loop of the split open loop resonator antenna of FIG. 2 may comprise one or any suitable number of members in the first plane and/or one or any suitable number of members in the second plane arranged in any suitable way.

The inner open loop of the split open loop resonator antenna of FIG. 2 may comprise any suitable number of structures in a first plane and/or any number of suitable structures in a second plane different from the first plane. The inner open loop of the split open loop resonator antenna of FIG. 2 may comprise any suitable number of structures distributed in any suitable number of different planes. Each of those structures may comprise any suitable number of members. The members may be electrically connected in a any suitable way through any suitable number of auxiliary structures extending from one plane to another.

By doing so, separate portions of at least one open loop of the antenna are arranged on at least two different planes. This allows to provide a more compact design of the antenna while still keeping a good antenna performance. The antenna can be smaller due to the split open loop resonator structure and due to the 3D unfolding on at least two different planes. It also shows higher radiation efficiency compared to other miniaturized designs based on full size antennas. It also allows the antenna to have a broad frequency band while at the same time reducing the size of the antenna. Unfolding at least one of the open loops of the antenna in at least two different planes also provides an antenna which performance depends less on the ground of the antenna.

Both open loops of the antenna, outer and inner open loops, have different portions that are arranged on at least two different planes, thereby providing an even more compact design. Therefore, the same radiation and bandwidth performance can be achieved with a smaller antenna.

The split open loop resonator antenna of FIG. 2 may comprise a stub or any other suitable number of stubs. The stubs of the split open loop resonator antenna of FIG. 2 may be used for impedance matching of the antenna. By modifying the length of the stubs, different impedances may be matched.

The split open loop resonator antenna of FIG. 2 may comprise a first stub 50. The first stub 50 may be a prolongation of the fifth main member 35. The first stub 50 may be arranged in the same plane as the fifth main member 35. The split open loop resonator antenna of FIG. 2 may comprise a second stub 51. The second stub 51 may be a prolongation of the fourth main member 34. The second stub 51 may be arranged in the same plane wherein the fourth main member 34 is arranged. The split open loop resonator antenna of FIG. 2 may further comprise a third stub 52. The third stub 52 may be a prolongation of the first additional member 25. The split open loop resonator antenna of FIG. 2 may comprise a fourth stub 53. The fourth stub 53 may be a prolongation of the second additional member 27.

Figure 3:
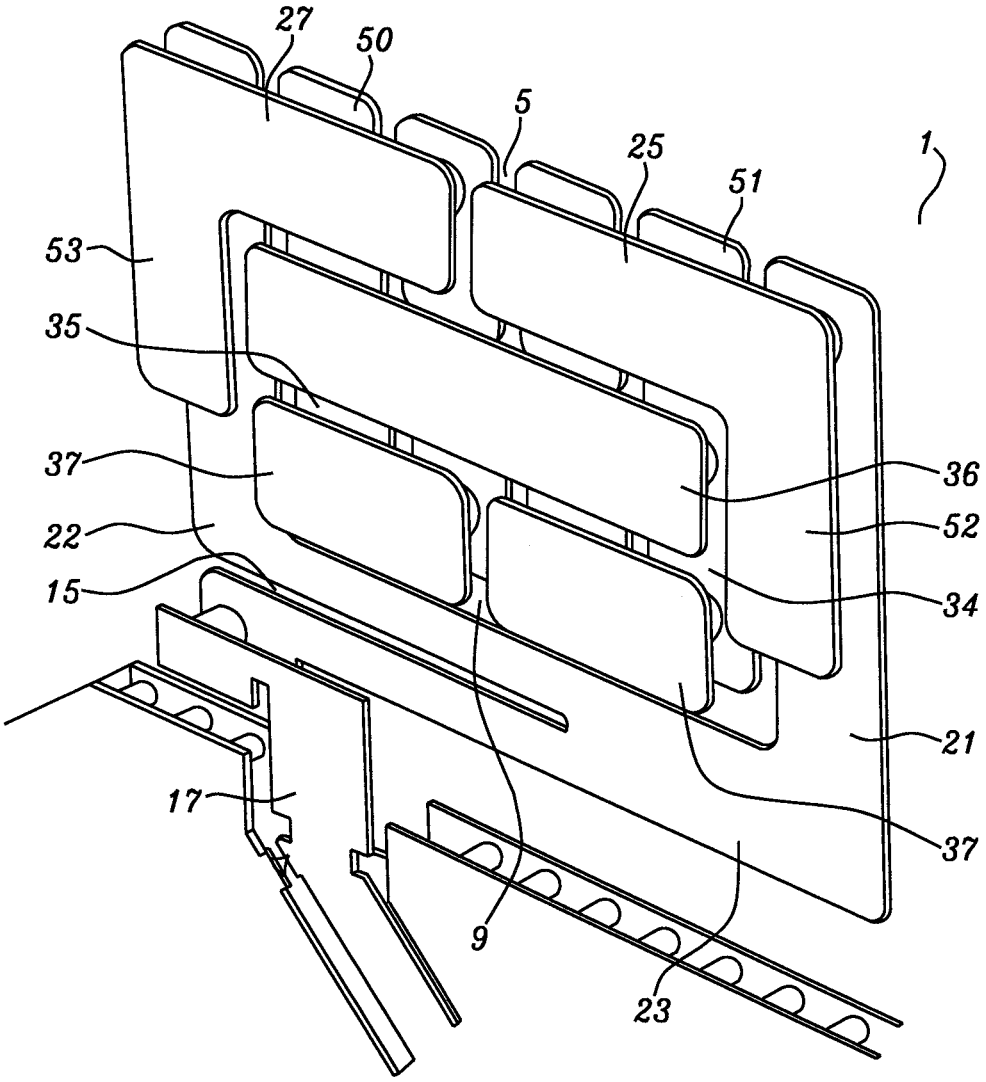
FIG. 3 shows a back view of the 3D folded split open loop resonator antenna of FIG. 2.

FIG. 3 shows a back view of the 3D folded split open loop resonator antenna of FIG. 2. The same reference numbers as in FIG. 2 have been used in FIG. 3 for indicating the same features.

Figure 4:
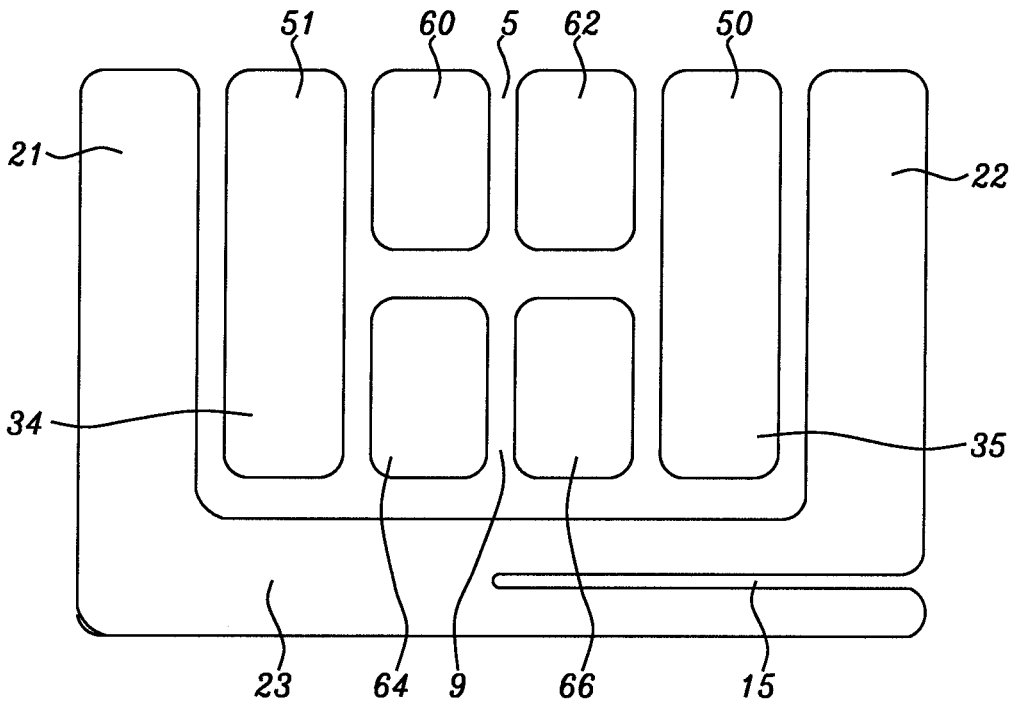
FIG. 4 shows a front projection of a 3D folded split open loop resonator antenna according to an embodiment of the invention.

FIG. 4 shows a front projection of the 3D folded split open loop resonator antenna of FIG. 2. The same reference numbers as in FIG. 2 have been used in FIG. 4 for indicating the same features.

Figure 5:
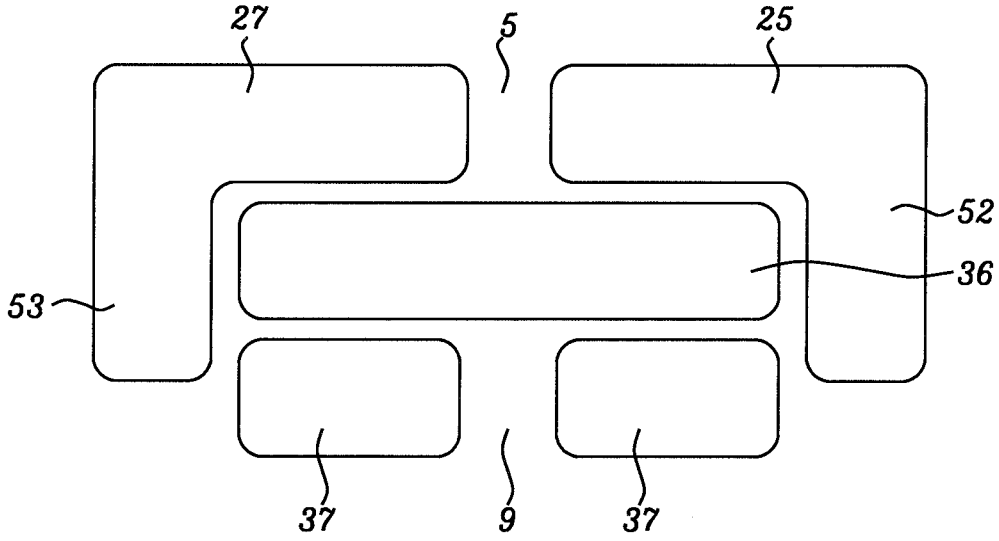
FIG. 5 shows a back projection of a 3D folded split open loop resonator antenna according to an embodiment of the invention.

FIG. 5 shows a back projection of the 3D folded split open loop resonator antenna of FIG. 2. The same reference numbers as in FIG. 2 have been used in FIG. 5 for indicating the same features.

Figure 6A:
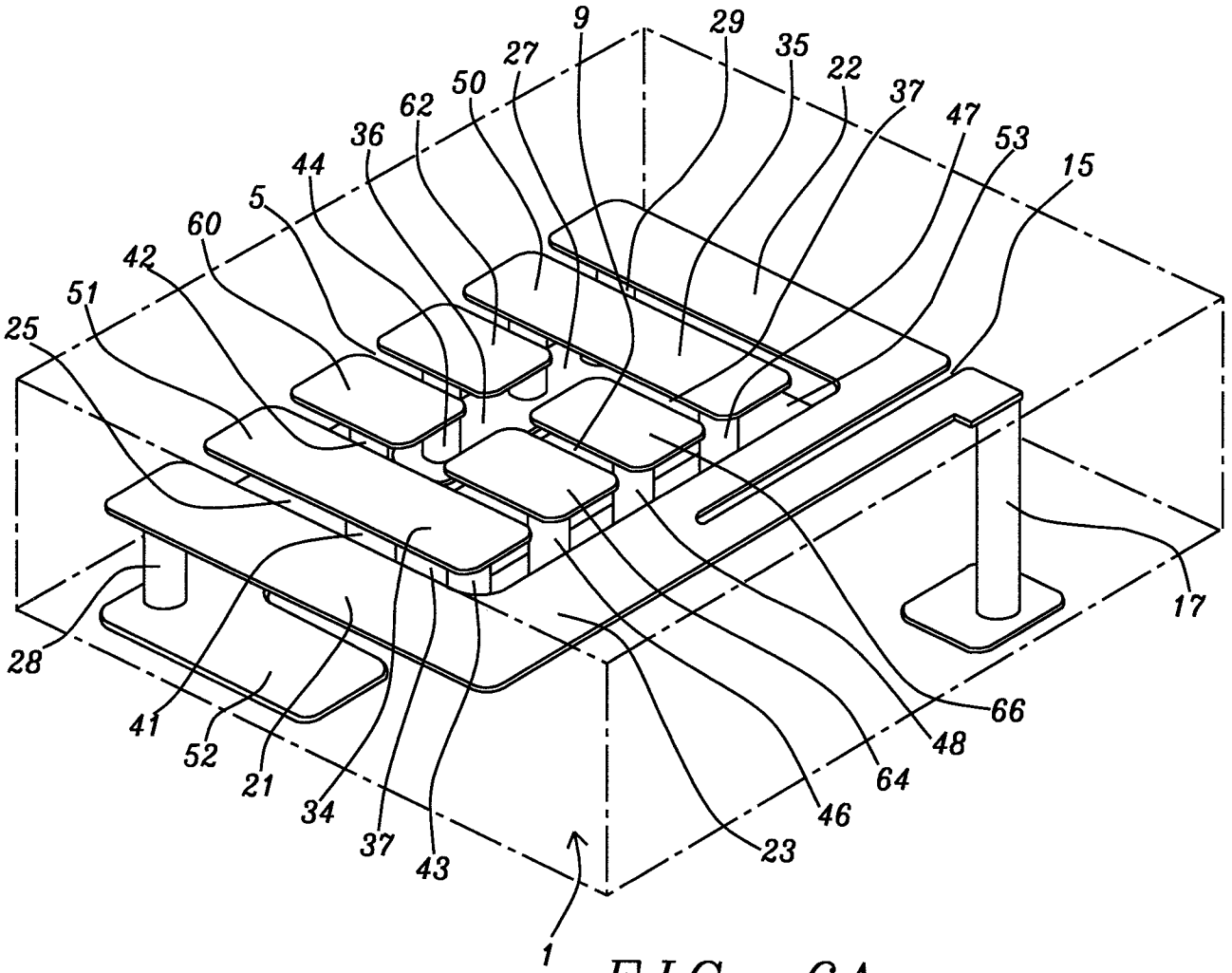
FIG. 6A shows a 3D folded split open loop resonator antenna inside of a dielectric block according to the invention.

FIG. 6A shows a 3D folded split open loop resonator antenna inside of a dielectric block according to the invention. The same reference numbers as in FIG. 2 have been used in FIG. 6A for indicating the same features. This dielectric block may be a high dielectric material.

The 3D split open loop resonator antenna of FIG. 6A has a high of 7 millimeters and a width of 9 millimeters. However, the 3D split open loop resonator antenna may have any suitable size. The dielectric block showed in FIG. 6A may be made of any suitable material with any suitable dielectric constant. The dielectric block showed in FIG. 6A may be a ceramic, glass-ceramic, alumina or any other high dielectric constant substrate commonly used in HTCC and LTCC technologies to manufacture for instance ceramic antenna or custom made baluns.

This provides a compact design of the antenna. The size of the antenna is decreases inversely proportional to the square root of the dielectric constant of the substrate on which the antenna is arranged. Thus, using materials with higher dielectric constant we can further reduce the antenna size.

Figure 6B:
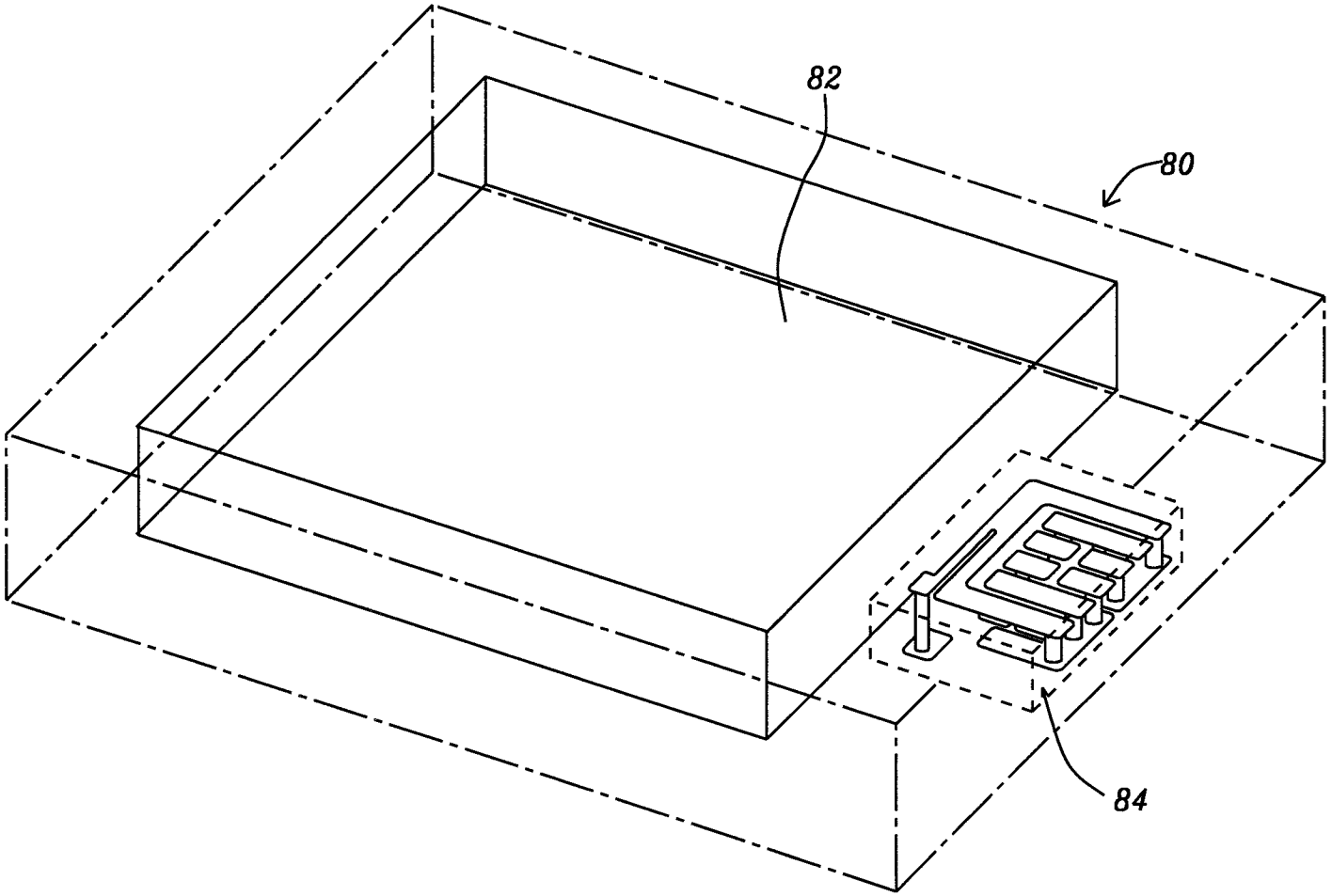
FIG. 6B shows the dielectric block containing the 3D folded split open loop resonator antenna of FIG. 6A and an IC radio placed in the same package.

FIG. 6B shows the dielectric block containing the 3D folded split open loop resonator antenna of FIG. 6A and an IC radio placed in the same package. In FIG. 6B, dielectric block 84 containing the 3D folded split open loop resonator antenna and the IC radio 82 are placed in the same package 80. The result is a single package 80 solution radio and antenna which can be used a stand-alone component. The single package 80 solution radio and antenna can be placed on a PCB. The package 80 may be made of any other suitable material.

Figure 7:
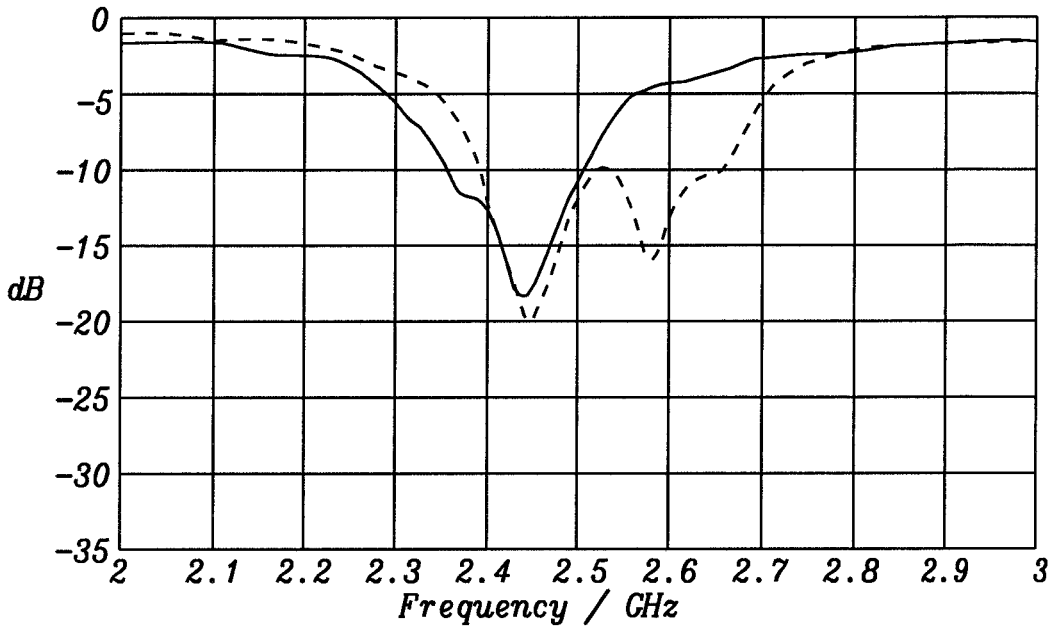
FIG. 7 and FIG. 8 illustrate simulation results comparing the 3D folded split open loop resonator antenna printed on Printed Circuit Board of FIG. 6A and a meander F-antenna.

FIG. 7 illustrates simulation results for the 3D folded split open loop resonator antenna of FIG. 6 and a meander F-antenna. In FIG. 7 the horizontal axe represents in Gigahertz the frequency at which the antennas are resonating. The vertical axe represents the $S_{11}$ parameter represented in decibels. The results corresponding to the meander F-antenna are represented in a dashed line. The results corresponding to the 3D folded split open loop resonator antenna are represented in a continuous line. The $S_{11}$ parameter is equal to the ratio between the power reflected from the antenna and the power delivered to the antenna. The meander F-antenna used in the simulations illustrated in FIG. 7 has a high of 7 millimeters and a width of 14 millimeters.

As shown in the simulations illustrated in FIG. 7 the measured frequency bandwidth after matching for the 3D folded split open loop resonator antenna of FIG. 6 wherein the $S_{11}$ parameter is below −10 decibels is 153 Megahertz, while for the meander F-antenna is 121 Megahertz.

Figure 8:
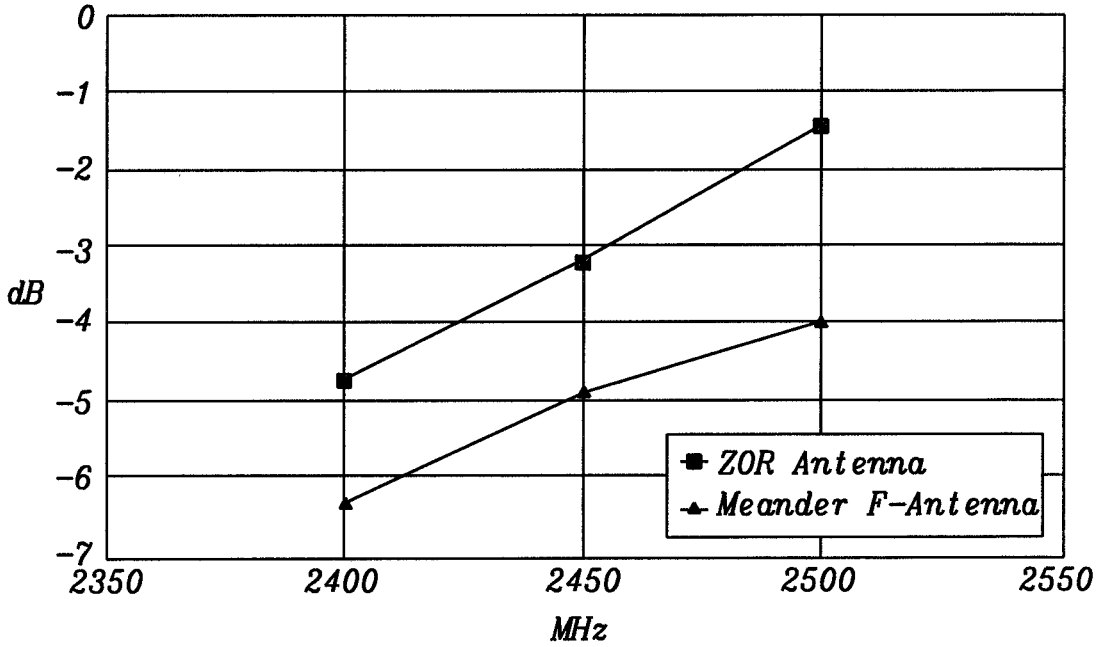

FIG. 8 illustrates simulation results for the 3D folded split open loop resonator antenna of FIG. 6 and the meander F-antenna used in the simulations illustrated in FIG. 7. In FIG. 8 the horizontal axe represents in Megahertz the frequency at which the antennas are resonating. The vertical axe represents the radiation efficiency in decibels.

The meander F-antenna used in the simulations illustrated in FIG. 8 has a high of 7 millimeters and a width of 14 millimeters.

The radiation efficiency is estimated by measuring the total radiated power in two orthogonal planes (DUT horizontal and DUT vertical) using both vertical and horizontal polarizations.

As shown in the simulations illustrated in FIG. 8 the 3D folded split open loop resonator antenna of FIG. 6 exhibits better radiation efficiency than the meander F-antenna for the represented frequencies. This comparison should be seen as relative and the efficiency numbers should not be seen as absolute values.

Figure 9:
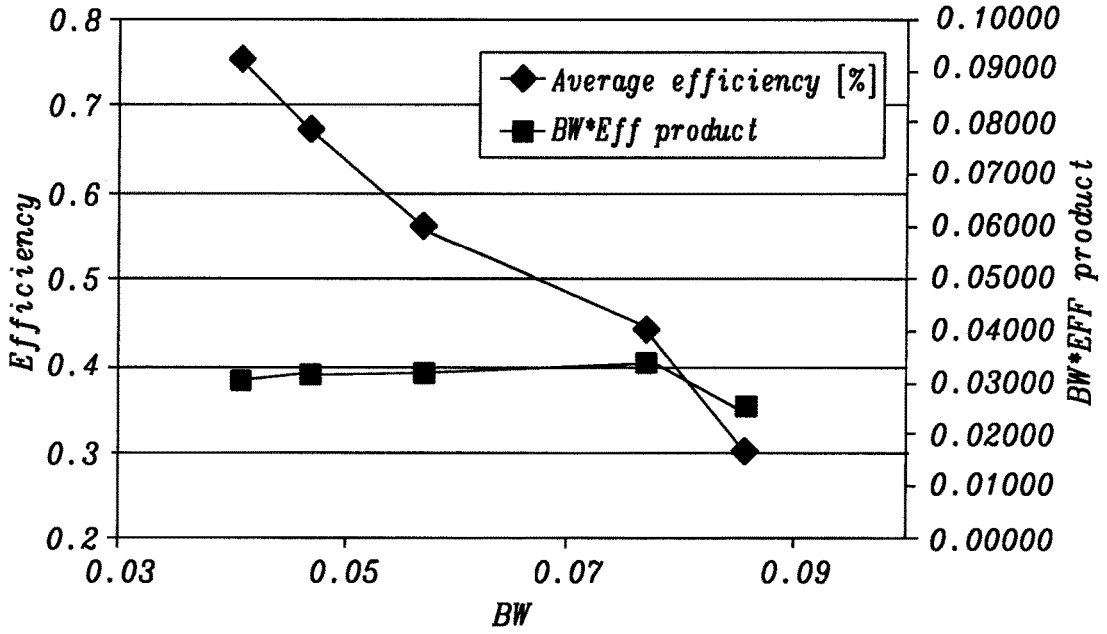
FIG. 9 and FIG. 10 illustrate simulation results of 3D folded split open loop resonator antenna of FIG. 6A.

FIG. 9 illustrates simulation results for the 3D folded split open loop resonator antenna of FIG. 6. Using a π network the antenna is matched to 50Ω. In FIG. 9 the horizontal axe represents in the frequency bandwidth of the antenna. The frequency bandwidth is expressed in % vs the ISM band center frequency $f_0$=2450 Megahertz. The vertical axe represents the radiation efficiency.

The frequency bandwidth is measured around the resonance point for $S_{11}$=−10 dB.

The radiation efficiency is expressed in % with reference to a nominal power of 0 dBm or 1 mW. The radiation efficiency is calculated using CST Microwave studio by integrating the 3D far field pattern. The efficiency reported below is the average value calculated using three frequency points: $f_1$=2400 Megahertz, $f_2$=2450 Megahertz and $f_3$=2500 Megahertz.

The antenna is based on the structure of the split open loop resonator, also known as zeroth order resonator. The most important feature of this structure is that it can sustain resonances at frequencies much lower than the ones dictated by its size. This property may be used to further decrease the antenna size. The challenge is to find the right balance between a broad matching frequency band and high radiation performance (radiation efficiency). This is a figure of merit for electrically small antennas and is given by the bandwidth*efficiency product. The split open loops must be placed on at least two different PCB layers and at minimum distance such that they remain closely coupled. Vias or auxiliary structures can be used to alternatively route the open loops on the PCB layers.

By changing the length of the slot, it is possible to fine tune the antenna impedance This provides an efficient way of matching the impedance. By adjusting the slot length, the bandwidth versus efficiency of the antenna may also be changed. The antenna may be made either more efficient but with a narrower bandwidth or less efficient but broadband by changing the length of the slot. In this way, it is possible to increase the bandwidth at the price of efficiency and vice-versa.

The below table corresponds to the same simulation results of FIG. 9.

The first column of the table shows different lengths of the stub in millimeters. The second column of the table shows the corresponding frequency bandwidth. The third column of the table shows the corresponding efficiency. The fourth column of the table shows the corresponding bandwidth*efficiency product. The fifth column of the table shows the corresponding quality factor Q.

| Slot length[mm] | Bandwidth[%] | Efficiency[%] | BW*EFF product | Q |
|---|---|---|---|---|
| 4.1 | 8.6 | 30 | 0.0257 | 8.3 |
| 4.6 | 7.7 | 44 | 0.03388 | 9.2 |
| 6.1 | 5.7 | 56 | 0.03192 | 12.6 |
| 6.6 | 4.7 | 67 | 0.03149 | 15.0 |
| 7.6 | 4.1 | 75 | 0.03061 | 17.0 |

Figure 10:
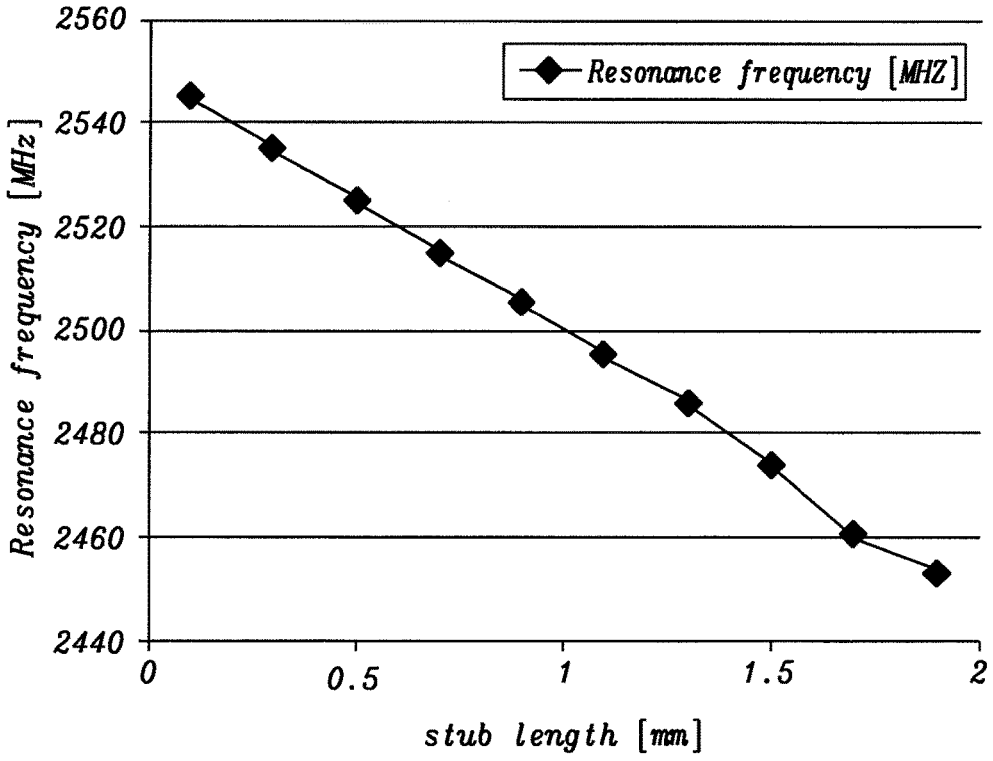

FIG. 10 illustrates simulation results for the 3D folded split open loop resonator antenna of FIG. 2. In FIG. 10 the horizontal axe represents in millimeters the stub length. The vertical axe represents resonance frequency represented in Megahertz.

The below table corresponds to the same simulation results of FIG. 10. The left column of the table shows different lengths of the stub in millimeters. The right column of the table shows the corresponding resonance frequencies in Megahertz.

As it can be seen from the below table and FIG. 10, the resonance frequency of the antenna can be changed by modifying the length of the stubs. In this way, the frequency tuning of the antenna is improved. The stubs are designed as prolongations of the two split open loops. This allows for having a compact design of the antenna with the stubs.

| Stub length[mm] | Resonance frequency [MHz] |
|---|---|
| 0.1 | 2545 |
| 0.3 | 2535 |
| 0.5 | 2525 |
| 0.7 | 2515 |
| 0.9 | 2505 |
| 1.1 | 2495 |
| 1.3 | 2486 |
| 1.5 | 2474 |
| 1.7 | 2460 |
| 1.9 | 2453 |

Figure 11:
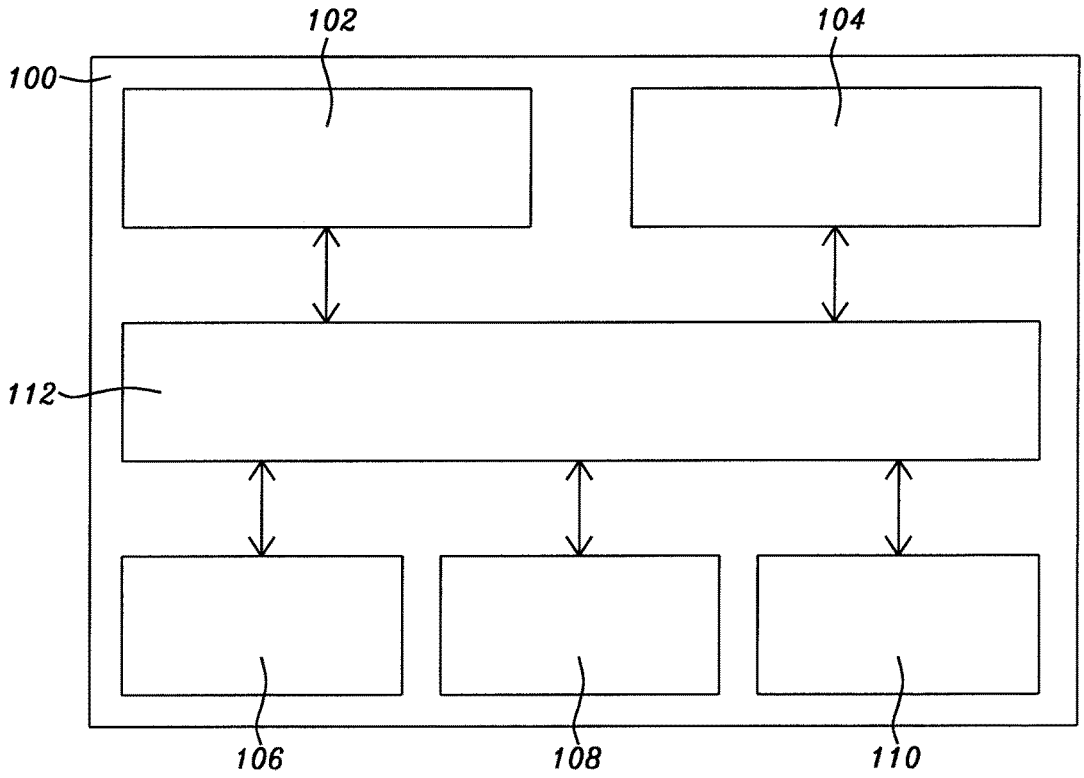
FIG. 11 is a block diagram of the electronic device of FIG. 6B.

FIG. 11 is a block diagram of the electronic device of FIG. 6B.

Referring to FIG. 11, the electronic device 100 may comprise a bus 112, a processor 102, a memory 104, an input and output interface 106, a display 108, and a communication interface 110. According to an embodiment of the present disclosure, the electronic device 100 may omit at least one of the elements (for example, the bus 112, the processor 102, the memory 104, the input and output interface 106, the display 108, and the communication interface 110) or may include additional elements.

The bus 112 may include a circuit which connects the elements (for example, the bus 112, the processor 102, the memory 104, the input and output interface 106, the display 108, and the communication interface 110) with one another and transmits communication (for example, a control message and/or data) between the above-described elements (for example, the bus 112, the processor 102, the memory 104, the input and output interface 106, the display 108, and the communication interface 110).

The processor 102 may include one or more of a CPU, an application processor (AP), or a communication processor (CP). The processor 102 may perform a calculation or process data related to control and/or communication of at least one other element.

The memory 104 may include a volatile and/or a non-volatile memory. For example, the memory 104 may store instructions or data which are related to at least one other element of the electronic device 100. According to an embodiment of the present disclosure, the memory 104 may store software and/or a program.

The input and output interface 106 may serve as an interface for transmitting instructions or data input from a user or another external device to other element(s) of the electronic device 100. In addition, the input and output interface 106 may output instructions or data received from other element(s) of the electronic device 100 to another external device.

The communication interface 110 may establish communication between the electronic device 100 and an external device. For example, the communication interface 110 may be connected to a network via wireless communication or wire communication.

According to an embodiment of the present disclosure, the communication interface 110 may include a plurality of modules that support a plurality of communication standards. The communication interface 110, which performs a function of transmitting and receiving signals, may be referred to as a transmitting unit, a receiving unit, a communication unit, or a transmitting/receiving unit (e.g. a transceiver).

The wireless communication may use, as a cellular communication protocol, at least one of long term evolution (LTE), LTE advanced (LTE-A), code division multiple access (CDMA), wideband CDMA (WCDMA), universal mobile telecommunication system (UMTS), wireless broadband (WiBro), or global system for mobile communications (GSM), etc. A wire communication may include at least one of a universal serial bus (USB), a high-definition multimedia interface (HDMI), a recommended standard 232 (RS-232), or a plain old telephone service (POTS). The network 162 may include a telecommunications network, for example, at least one of a computer network (for example, a LAN or a wide area network (WAN)), an internet, or a telephone network.

What is claimed is:

1. A split open loop resonator antenna comprising:

a first electrically connected open loop structure, said first electrically connected open loop structure comprising a first slit;

a second electrically connected open loop structure, said second electrically connected open loop structure comprising a second slit;

said first electrically connected open loop structure comprising at least a first main structure being a portion of a first open loop with a first open loop shape and a first additional structure being another portion of said first open loop, said second electrically connected open loop structure comprising at least a second main structure, said first main structure being arranged in a first plane of a plurality of planes, said first additional structure being arranged in a second plane of said plurality of planes different from said first plane, said plurality of planes being parallel to each other and said first main structure being electrically connected to said first additional structure, said first main structure and said first additional structure being arranged such that when projected in a first same plane parallel to said first and second planes they cover at least said first open loop shape with said first slit, wherein the first electrically connected open loop structure and the second electrically connected open loop structure form the split open loop resonator antenna.

2. The split open loop resonator antenna according to claim 1, said second main structure being a portion of a second open loop with a second open loop shape and being arranged in a third plane of said plurality of planes that may coincide with the first plane, said second electrically connected open loop structure comprising at least a second additional structure being another portion of said second open loop, said second additional structure being arranged in a fourth plane of said plurality of planes that may coincide with said second plane and said second main structure being electrically connected to said second additional structure, said second main structure and said second additional structure being arranged such that when projected in a second same plane parallel to said third and fourth planes they cover at least said second open loop shape with said second slit.

3. The split open loop resonator antenna according to claim 2, said second main structure comprising at least one fourth main member and at least one fifth main member, said at least one fourth main member and said at least one fifth main member being parallel to each other, and said second additional structure comprising at least one third additional member and at least one fourth additional member, said at least one fourth additional member comprising submembers arranged such as to define said second slit, said at least one third additional member and said at least one fourth additional member being parallel to each other, said at least one third additional member and said fourth additional member being perpendicular to said at least one fourth main member and said at least one fifth main member, said at least one fourth main member being respectively electrically connected to said at least one third additional member and said at least one fourth additional member through respectively a third auxiliary structure and a fourth auxiliary structure, and said at least one fifth main member being respectively electrically connected to said at least one third additional member and said at least one fourth additional member through respectively a fifth auxiliary structure and a sixth auxiliary structure.

4. The split open loop resonator antenna according to claim 1, comprising a dielectric substrate, such that said first and second main structures and said first additional structure are arranged on said dielectric substrate.

5. The split open loop resonator antenna according to claim 4, wherein the dielectric substrate comprises a high dielectric material.

6. The split open loop resonator antenna according to claim 1, said first electrically connected open loop structure comprising at least a first prolongation structure extending from said first electrically connected open loop structure and being arranged to operate as a first stub.

7. The split open loop resonator antenna according to claim 1, said second electrically connected open loop structure comprising at least a second prolongation structure extending from said second electrically connected open loop structure and being arranged to operate as a second stub.

8. The split open loop resonator antenna according to claim 1, said first electrically connected open loop structure comprising a slot for impedance matching.

9. The split open loop resonator antenna according to claim 1, said second electrically connected open loop structure comprising a slot for impedance matching.

10. The split open loop resonator antenna according to claim 1, said first electrically connected open loop structure and/or said second electrically connected open loop structure comprising an annular shape.

11. The split open loop resonator antenna according to claim 1, said first main structure comprising a first main member, a second main member and a third main member, said first main member, said second main member and said third main member being electrically connected, said first main member and said third main member being parallel to each other, said second main member being perpendicular respectively to said first main member and said third main member, such that said first main member, said second main member and said third main member form a U-shaped structure, said first additional structure comprising at least one first additional member and at least one second additional member arranged such as to define said first slit, said first additional member and second additional member, respectively, being electrically connected to said first main member and said third main member, respectively, through a first auxiliary member and a second auxiliary member, respectively, both extending from the first plane to the second plane.

12. An integrally packaged integrated circuit comprising a split open loop resonator antenna comprising:

a first electrically connected open loop structure, said first electrically connected open loop structure comprising a first slit;

a second electrically connected open loop structure, said second electrically connected open loop structure comprising a second slit;

said first electrically connected open loop structure comprising at least a first main structure being a portion of a first open loop with a first open loop shape and a first additional structure being another portion of said first open loop, said second electrically connected open loop structure comprising at least a second main structure, said first main structure being arranged in a first plane of a plurality of planes, said first additional structure being arranged in a second plane of said plurality of planes different from said first plane, said plurality of planes being parallel to each other and said first main structure being electrically connected to said first additional structure, said first main structure and said first additional structure being arranged such that when projected in a first same plane parallel to said first and second planes they cover at least said first open loop shape with said first slit, wherein the first electrically connected open loop structure and the second electrically connected open loop structure form the split open loop resonator antenna.

13. The integrally packaged integrated circuit comprising the split open loop resonator antenna according to claim 12, wherein said integrally packaged integrated circuit also comprises a radio frequency circuit.

14. A method for providing a split open loop resonator antenna comprising the steps of:

providing a split open loop resonator antenna comprising:

a first electrically connected open loop structure, said first electrically connected open loop structure comprising a first slit;

a second electrically connected open loop structure, said second electrically connected open loop structure comprising a second slit;

said first electrically connected open loop structure comprising at least a first main structure being a portion of a first open loop with a first open loop shape and a first additional structure being another portion of said first open loop, said second electrically connected open loop structure comprising at least a second main structure, said first main structure being arranged in a first plane of a plurality of planes, said first additional structure being arranged in a second plane of said plurality of planes different from said first plane, said plurality of planes being Parallel to each other and said first main structure being electrically connected to said first additional structure, said first main structure and said first additional structure being arranged such that when projected in a first same plane parallel to said first and second planes they cover at least said first open loop shape with said first slit, wherein the first electrically connected open loop structure and the second electrically connected open loop structure form the split open loop resonator antenna.

15. The method for providing a split open loop resonator antenna according to claim 14, said second main structure being a portion of a second open loop with a second open loop shape and being arranged in a third plane of said plurality of planes that may coincide with the first plane, said second electrically connected open loop structure comprising at least a second additional structure being another portion of said second open loop, said second additional structure being arranged in a fourth plane of said plurality of planes that may coincide with said second plane and said second main structure being electrically connected to said second additional structure, said second main structure and said second additional structure being arranged such that when projected in a second same plane parallel to said third and fourth planes they cover at least said second open loop shape with said second slit.

16. The method for providing a split open loop resonator antenna according to claim 15, said second main structure comprising at least one fourth main member and at least one fifth main member, said at least one fourth main member and said at least one fifth main member being parallel to each other, and said second additional structure comprising at least one third additional member and at least one fourth additional member, said at least one fourth additional member comprising submembers arranged such as to define said second slit, said at least one third additional member and said at least one fourth additional member being parallel to each other, said at least one third additional member and said fourth additional member being perpendicular to said at least one fourth main member and said at least one fifth main member, said at least one fourth main member being respectively electrically connected to said at least one third additional member and said at least one fourth additional member through respectively a third auxiliary structure and a fourth auxiliary structure, and said at least one fifth main member being respectively electrically connected to said at least one third additional member and said at least one fourth additional member through respectively a fifth auxiliary structure and a sixth auxiliary structure.

17. The method for providing a split open loop resonator antenna according to claim 14, comprising a dielectric substrate, such that said first and second main structures and said first additional structure are arranged on said dielectric substrate.

18. The method for providing a split open loop resonator antenna according to claim 17, wherein the dielectric substrate comprises a high dielectric material.

19. The method for providing a split open loop resonator antenna according to claim 14, said first electrically connected open loop structure comprising at least a first prolongation structure extending from said first electrically connected open loop structure and being arranged to operate as a first stub.

20. The method for providing a split open loop resonator antenna according to claim 14, said second electrically connected open loop structure comprising at least a second prolongation structure extending from said second electrically connected open loop structure and being arranged to operate as a second stub.

21. The method for providing a split open loop resonator antenna according to claim 14, said first electrically connected open loop structure comprising a slot for impedance matching.

22. The method for providing a split open loop resonator antenna according to claim 14, said second electrically connected open loop structure comprising a slot for impedance matching.

23. The method for providing a split open loop resonator antenna according to claim 14, said first electrically connected open loop structure and/or said second electrically connected open loop structure comprising an annular shape.

24. The method for providing a split open loop resonator antenna according to claim 14, said first main structure comprising a first main member, a second main member and a third main member, said first main member, said second main member and said third main member being electrically connected, said first main member and said third main member being parallel to each other, said second main member being perpendicular respectively to said first main member and said third main member, such that said first main member, said second main member and said third main member form a U-shaped structure, said first additional structure comprising at least one first additional member and at least one second additional member arranged such as to define said first slit, said first additional member and second additional member, respectively, being electrically connected to said first main member and said third main member, respectively, through a first auxiliary member and a second auxiliary member, respectively, both extending from the first plane to the second plane.

25. The method for providing a split open loop resonator antenna according to claim 14 comprising a high dielectric substrate.

* * * * *